US010192498B2

(12) United States Patent
Cao et al.

(10) Patent No.: US 10,192,498 B2
(45) **Date of Patent: *Jan. 29, 2019**

(54) MULTI-DOMAIN LIQUID CRYSTAL DISPLAY DEVICE WITH IMPROVED TRANSMITTANCE AND VIEWING ANGLES

(71) Applicant: Hisense Electric Co., Ltd., Qingdao, Shandong (CN)

(72) Inventors: Jianwei Cao, Shandong (CN); Shunming Huang, Shandong (CN); Weidong Liu, Shandong (CN)

(73) Assignee: Hisense Electric Co., Ltd., Qingdao (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/102,235

(22) Filed: Aug. 13, 2018

(65) Prior Publication Data

US 2018/0350312 A1 Dec. 6, 2018

Related U.S. Application Data

(63) Continuation of application No. 14/976,782, filed on Dec. 21, 2015, now Pat. No. 10,078,989.

(30) Foreign Application Priority Data

Feb. 13, 2015 (CN) ..... 2015 1 0079895

(51) Int. Cl.
*G09G 3/36* (2006.01)
*G09G 3/20* (2006.01)

(52) U.S. Cl.
CPC ..... *G09G 3/3607* (2013.01); *G09G 3/2007* (2013.01); *G09G 2300/0447* (2013.01); *G09G 2340/16* (2013.01)

(58) Field of Classification Search
CPC ..... G09G 3/3607; G09G 3/2007
See application file for complete search history.

(56) References Cited

U.S. PATENT DOCUMENTS

2010/0033473 A1* 2/2010 Hsieh ..... G09G 3/003 345/213
2010/0225747 A1* 9/2010 Chen ..... G09G 3/003 348/51

(Continued)

*Primary Examiner* — Lisa S Landis
(74) *Attorney, Agent, or Firm* — Brinks Gilson & Lione

(57) ABSTRACT

The present disclosure provides an image display method and apparatus, and a multi-domain liquid crystal display device, relates to the field of display technologies. The image display method applied to a multi-domain liquid crystal display device includes: acquiring grayscales of pixels in a frame of an input image; determining GAMMA voltages corresponding to pixels in two neighboring frames of an output image according to the grayscales of the pixels in the frame of the input image, where for any pixel of the output image, a corresponding GAMMA voltage thereof in a first frame of the two neighboring frames is greater than a reference voltage corresponding to the pixel, and a corresponding GAMMA voltage thereof in a second frame of the two neighboring frames is less than the reference voltage; and displaying the two neighboring frames of the output image according to the GAMMA voltages of the pixels therein.

20 Claims, 6 Drawing Sheets

(56) References Cited

U.S. PATENT DOCUMENTS

2012/0120067 A1* 5/2012 Kim ..... G02B 27/2264
345/419
2014/0232756 A1* 8/2014 Choi ..... G09G 3/36
345/690

* cited by examiner

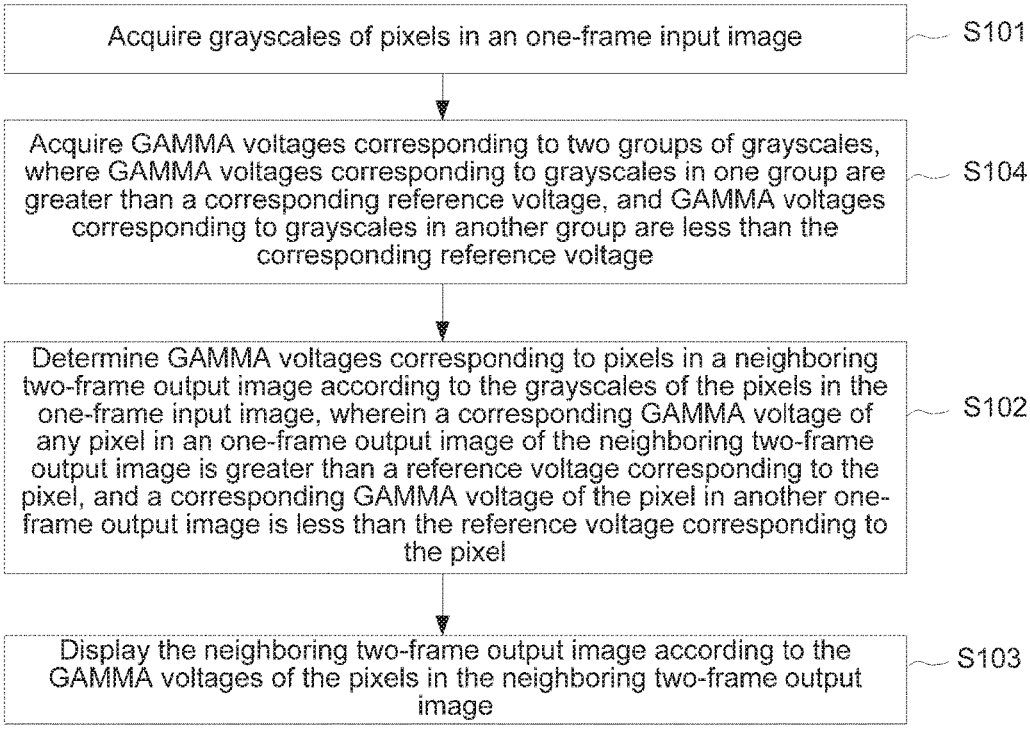

FIG. 8

$i^{th}$ frame output image

| | |
|---|---|
| A GAMMA voltage of a is greater than a reference voltage | A GAMMA voltage of b is less than the reference voltage |
| A GAMMA voltage of c is less than the reference voltage | A GAMMA voltage of d is greater than the reference voltage |

$i+1^{th}$ frame output image

| | |
|---|---|
| A GAMMA voltage of a is less than a reference voltage | A GAMMA voltage of b is greater than the reference voltage |
| A GAMMA voltage of c is greater than the reference voltage | A GAMMA voltage of d is less than the reference voltage |

FIG. 9

MULTI-DOMAIN LIQUID CRYSTAL DISPLAY DEVICE WITH IMPROVED TRANSMITTANCE AND VIEWING ANGLES

PRIORITY STATEMENT

This application is a continuation of U.S. patent application Ser. No. 14/976,782 filed on Dec. 21, 2015, which claims the priority benefit to Chinese Patent Application No. 201510079895.7 filed on Feb. 13, 2015, the disclosures of which are herein incorporated by reference in their entireties.

BACKGROUND

The present disclosure relates to the field of display technologies, and in particular, to an image display method and apparatus, and a multi-domain liquid crystal display device.

RELATED ART

In the field of electronic video display and broadcasting, clearer image is always an object for manufacturers to pursue. Improvement in definition of an image is mainly implemented by improving resolution, because higher resolution may mean higher capability to display subtler details and a picture we see on a screen with higher resolution has more abundant colors and details. In order to pursue higher display quality, display resolution develops from 480p standard definition (SD) to 720p high definition (HD) to 1080p full high definition (FHD) till recent 4K ultra high definition (UHD) display starts to enter a civilian field, from which we can see that the display field has a tendency of pursuing displaying high resolution.

Compared with a pixel of a FHD liquid crystal panel, a pixel of a currently mainstream 4K UHD liquid crystal panel increases by 4 times. Therefore, resolution of the UHD is four times that of the FHD. Specifically, as shown in FIG. 1, areas of four pixels B, C, D, and E of the UHD is the same as that of a pixel A of the FHD liquid crystal panel. However, owing to an increase in pixels, the numbers of data lines, grid lines, and the like on a liquid crystal panel increase, and the data lines, the grid lines, and the like need to be shaded by using a black matrix, so that overall transmittance of the pixels is reduced. By using a 55-inch panel as an example, transmittance of the FHD liquid crystal panel is about 6%, and transmittance of the UHD liquid crystal panel is about 4%.

In order to improve transmittance, in the prior art, the number of subdomains of the liquid crystal panel may generally be decreased, for example, original eight subdomains are changed into four subdomains. However, reducing the number of subdomains may also lower a viewing angle of the liquid crystal panel. Thus, for UHD displays, achieving a high transmittance while maintaining a wide viewing angle is an urgent problem to solve.

SUMMARY

Embodiments of the present disclosure provide an image display method and apparatus, and a multi-domain liquid crystal display device. In the image display method, a corresponding GAMMA voltage of any pixel in a frame of output image of the two neighboring frames of output image is greater than a reference voltage corresponding to the pixel, and a corresponding GAMMA voltage of the pixel in another frame of output image is less than the reference voltage corresponding to the pixel. Relying on integration effects of human eyes on time, eight different liquid crystal directors, that is, equal to display viewing angle effects of eight subdomains, are seen based on a four-subdomain display panel, thereby implementing high resolution display and having high transmittance and a large viewing angle.

In order to achieve the foregoing objective, the embodiments of the present disclosure use the following technical solutions.

An embodiment of the present disclosure provides an image display method applied to a multi-domain liquid crystal display device, including:

acquiring grayscales of pixels in a frame of input image;

determining GAMMA voltages corresponding to pixels in two neighboring frames of output image according to the grayscales of the pixels in the frame of input image, where a corresponding GAMMA voltage of any pixel in a frame of output image of the two neighboring frames of output image is greater than a reference voltage corresponding to the pixel, and a corresponding GAMMA voltage of the pixel in another frame of output image is less than the reference voltage corresponding to the pixel; and displaying the two neighboring frames of output image according to the GAMMA voltages of the pixels in the two neighboring frames of output image.

An embodiment of the present disclosure provides an image display method applied to a multi-domain liquid crystal display device, including:

acquiring grayscales of pixels in an ith frame input image and a jth frame input image, where an ith frame and a jth frame are two neighboring frames;

determining GAMMA voltages corresponding to pixels in an ith frame output image according to the grayscales of the pixels in the ith frame input image, and determining GAMMA voltages corresponding to pixels in an jth frame output image according to the grayscales of the pixels in the jth frame input image, where a corresponding GAMMA voltage of any pixel in the ith frame output image is greater than a reference voltage corresponding to the pixel, and a corresponding GAMMA voltage of the pixel in the jth frame output image is less than the reference voltage corresponding to the pixel;

displaying the ith frame output image according to the GAMMA voltages of the pixels in the ith frame output image; and displaying the jth frame output image according to the GAMMA voltages of the pixels in the jth frame output image.

An embodiment of the present disclosure provides an image display apparatus applied to a multi-domain liquid crystal display device, including:

a first acquisition unit, configured to acquire grayscales of pixels in a frame of input image;

a first determination unit, configured to determine GAMMA voltages corresponding to pixels in two neighboring frames of output image according to the grayscales of the pixels in the frame of input image, where a corresponding GAMMA voltage of any pixel in a frame of output image of the two neighboring frames of output image is greater than a reference voltage corresponding to the pixel, and a corresponding GAMMA voltage of the pixel in another frame of output image is less than the reference voltage corresponding to the pixel; and a first display unit, configured to display the two neighboring frames of output image according to the GAMMA voltages of the pixels in the two neighboring frames of output image.

An embodiment of the present disclosure provides an image display apparatus applied to a multi-domain liquid crystal display device, including:

a second acquisition unit, configured to acquire grayscales of pixels in an ith frame input image and a jth frame input image, where an ith frame and a jth frame are two neighboring frames;

a second determination unit, configured to determine GAMMA voltages corresponding to pixels in an ith frame output image according to the grayscales of the pixels in the ith frame input image, and determining GAMMA voltages corresponding to pixels in an jth frame output image according to the grayscales of the pixels in the jth frame input image, where a corresponding GAMMA voltage of any pixel in the ith frame output image is greater than a reference voltage corresponding to the pixel, and a corresponding GAMMA voltage of the pixel in the jth frame output image is less than the reference voltage corresponding to the pixel; and a second display unit, configured to display the ith frame output image according to the GAMMA voltages of the pixels in the ith frame output image, and display the jth frame output image according to the GAMMA voltages of the pixels in the jth frame output image.

An embodiment of the present disclosure provides a multi-domain liquid crystal display device, including the image display apparatuses according to any one of the embodiments of the present disclosure.

In the image display method and apparatus, and the multi-domain liquid crystal display device according to the embodiments of the present disclosure, a corresponding GAMMA voltage of any pixel in a frame of output image of the two neighboring frames of output image is greater than a reference voltage corresponding to the pixel, and a corresponding GAMMA voltage of the pixel in another frame of output image is less than the reference voltage corresponding to the pixel. Moreover, for a same display device, a correspondence between a voltage and transmittance does not change, that is, transmittance of a grayscale of any pixel in a frame of input image under the frame of output image is greater than transmittance of the pixel under the reference voltage, and transmittance of the grayscale under the another frame of output image is less than the transmittance of the pixel under the reference voltage. Relying on integration effects of human eyes on time, a display image received by the human eyes is overlapping of the two-frame output image. For example, for a four-subdomain display device, four different liquid crystal directors can be seen from each frame, and the human eyes can see eight different liquid crystal directors from two neighboring frames, thereby improving a property of a display viewing angle. That is, eight-subdomain viewing angle display effects can be implemented based on a four-subdomain display device, thereby implementing high resolution display and having high transmittance and a large viewing angle when a display panel is not changed.

BRIEF DESCRIPTION OF THE DRAWINGS

To describe the technical solutions of the embodiments of the present disclosure or the existing technology more clearly, the following briefly introduces the accompanying drawings required for describing the embodiments or the existing technology. Apparently, the accompanying drawings in the following description show only some embodiments of the present disclosure, and a person of ordinary skill in the art may still derive other drawings from these accompanying drawings without creative efforts.

FIG. 8 is a flowchart of another image display method according to an embodiment of the present disclosure;

FIG. 9 is a schematic illustration of space compensation of a pixel according to an embodiment of the present disclosure;

REFERENCE NUMERALS

1—an upper substrate; 2—a lower substrate; 11—a protuberance of the upper substrate; 13—a black matrix; 101—a first subpixel; 102—a second subpixel; and 21—a protuberance of the lower substrate.

DETAILED DESCRIPTION

The following further clearly describes the technical solutions in the embodiments of the present disclosure in detail with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

Traditionally, transmittance is generally improved by decreasing the number of subdomains of a liquid crystal panel, for example, original eight subdomains are changed into four subdomains. An image display method and apparatus according to the embodiments of the present disclosure are both applied to a multi-domain liquid crystal display device. In order to make technical solutions provided in the embodiments of the present disclosure more comprehensible, a principle of multi-domain liquid crystal display is described first.

Figure 1:
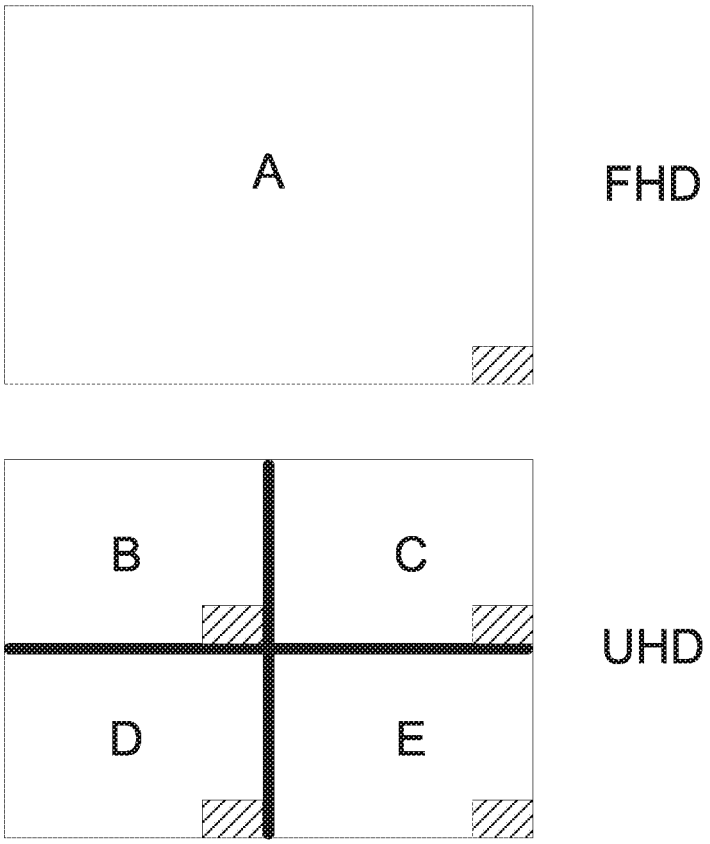
FIG. 1 (Prior Art)
FIG. 1 is a comparison schematic flowchart of an existing UHD display pixel and an FHD display pixel.
Figure 2:
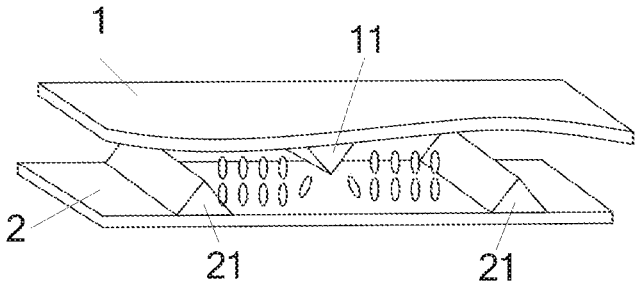
FIG. 2 is a schematic illustration of liquid crystal arrangement of an existing vertical alignment (VA) mode display when no voltage is applied according to an embodiment of the present disclosure.
Figure 3:
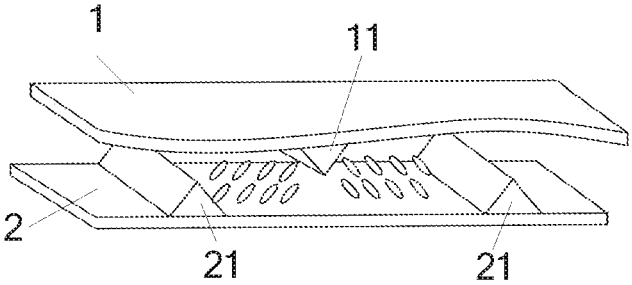
FIG. 3 is a schematic illustration of liquid crystal arrangement of the display shown in FIG. 2 when a voltage is applied.

As shown in FIG. 2, in a double-domain VA mode display shown in FIG. 2, when no voltage is applied, a long axis of a liquid crystal molecule between an upper substrate 1 and a lower substrate 2 is perpendicular to a screen; and merely a liquid crystal molecule that is close to an electrode of a protuberance (that is, a protuberance 11 of the upper substrate 1 and a protuberance 21 of the lower substrate 2 shown in FIG. 2) is slightly inclined, and a light cannot pass through a display panel. As shown in FIG. 3, when a voltage is applied, the liquid crystal molecule near the protuberance quickly leads other liquid crystal to rotate to a state of being perpendicular to a surface of the protuberance, and controls a deflection angle of the liquid crystal by controlling an electric field of the protuberance 11 of the upper substrate 1 and the protuberance 21 of the lower substrate 2, thereby adjusting transmittance of the light. As shown in FIG. 3, in such a double-domain mode, long axes of a liquid crystal on two sides of the protuberance 11 of the upper substrate 1 are symmetric and point at different directions, and the double-domain VA mode display implements optical compensation by using the different directions of molecule long axes.

Figure 4:
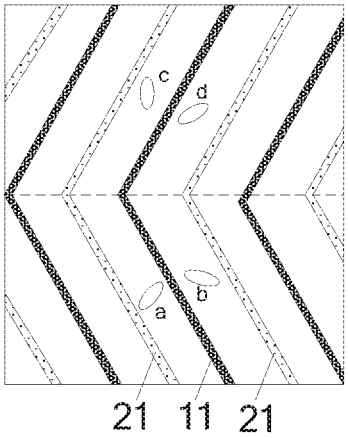
FIG. 4 is a schematic illustration of a pixel of a four-subdomain display according to an embodiment of the present disclosure.

As shown in FIG. 4, when a protuberance in a pixel is circuitously set (e.g., being set in a zigzag way), the liquid crystal molecule can be skillfully divided into four subdomains. For a four-subdomain mode display when a voltage is applied, liquid crystal molecules a, b, c, and d of each domains respectively direct to four directions to rotate, which compensates upper, lower, left, and right angles of the liquid crystal display at the same time. Therefore, the four-subdomain mode VA liquid crystal display has good viewing angles from the four directions.

Figure 5:
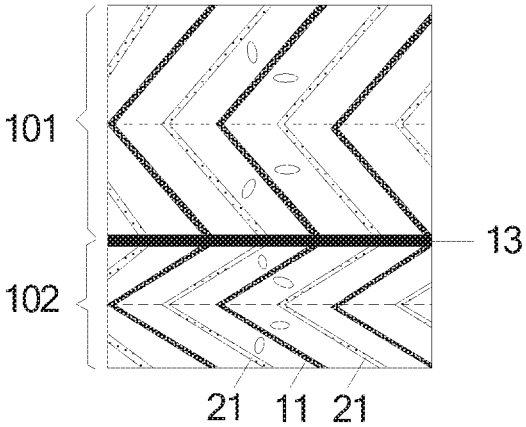
FIG. 5 is a schematic illustration of a pixel of an eight-subdomain display according to an embodiment of the present disclosure.

Based on such a compensation principle, any viewing angle can be compensated by using more liquid crystal domains of different directions, so as to obtain a better viewing angle effect. As shown in FIG. 5, FIG. 5 is an eight-subdomain mode VA liquid crystal display. A pixel includes a first subpixel 101 and a second subpixel 102 of different sizes, so that the first subpixel 101 and the second subpixel 102 have a certain voltage difference. Each subpixel forms a four-subdomain, and two subpixels form an eight-subdomain, that is, the subpixel of an eight-subdomain mode is twice of the subpixel of a four-subdomain mode. In this way, not only production difficulty is increased, but also a grid line, a data line, and the like are set between two subpixels, and both need to be shaded by using a black matrix 13, thereby decreasing a non-opaque area of a pixel, that is, reducing transmittance of the pixel. Conventionally, transmittance is improved by decreasing the number of subdomains of the display panel, but a viewing angle of the display panel may be lowered at the same time. However, in an image display method according to the embodiments of the present disclosure, a display effect of eight subdomains is implemented based on a four-subdomain liquid crystal panel, thereby implementing high resolution display and having high transmittance and a large viewing angle.

Figure 6:
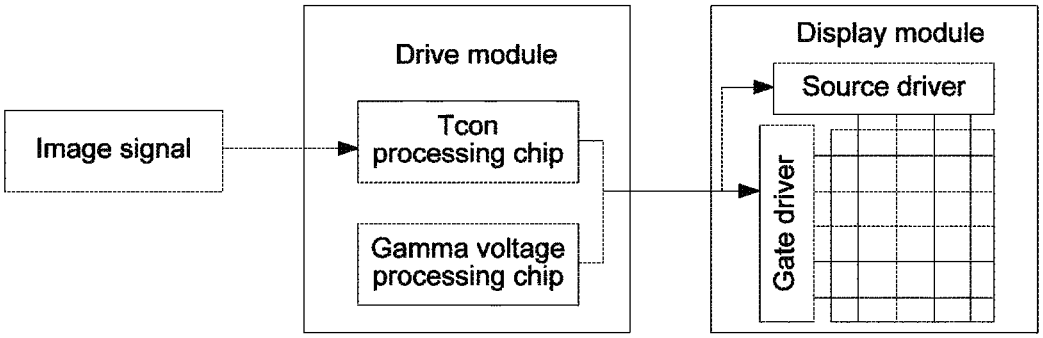
FIG. 6 is a flowchart of a display drive principle according to an embodiment of the present disclosure.

For no matter which display device, a display principle thereof can refer to what is shown in FIG. 6. A Tcon processing chip processes a frame of image signal of an LVDS format into grayscales of pixels on a corresponding display module; a Gamma voltage processing chip is mainly configured to output GAMMA voltages corresponding to a part of the grayscales; and a source driver determines GAMMA voltages corresponding to the pixels by using a digital-to-analog converter according to the GAMMA voltages corresponding to a part of the grayscales output by the Gamma voltage processing chip, and outputs the GAMMA voltages by obtaining data. By using a liquid crystal display device as an example, different data voltages control liquid crystals of different pixels to deflect for different angles, so that a pixel displays corresponding grayscales.

In order to enable a person skilled in the art to understand the present disclosure more clearly, the following describes the technical solutions according to the embodiments of the present disclosure in detail with reference to the accompanying drawings.

Embodiment 1

Figure 7:
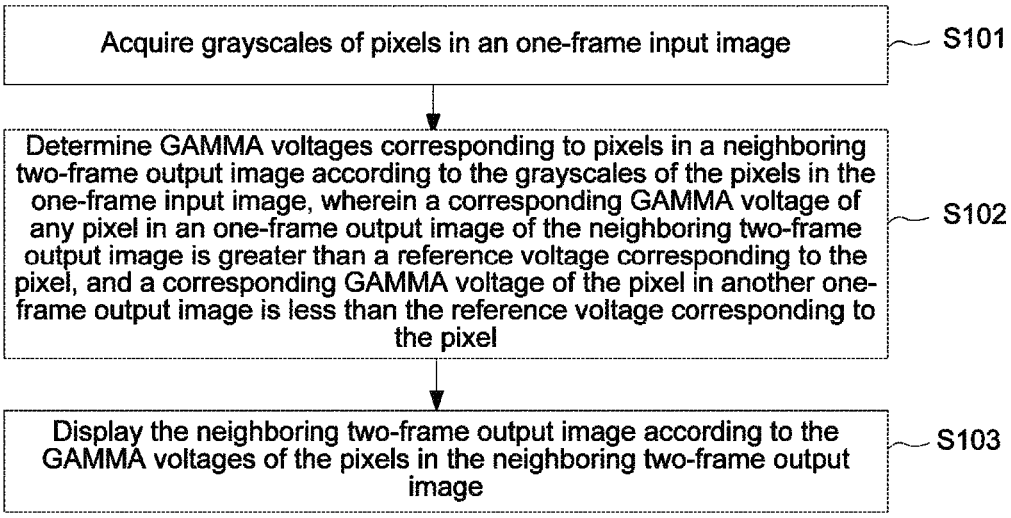
FIG. 7 is a flowchart of an image display method according to an embodiment of the present disclosure.

This embodiment of the present disclosure provides an image display method and apparatus applied to a multi-domain liquid crystal display device. In reality, the multi-domain liquid crystal display device may be a television, an online video playback device, or the like. This embodiment of the present disclosure is described in detail by using that the multi-domain liquid crystal display device is a four-subdomain liquid crystal display television whose resolution is 3800×2160 as an example. As shown in FIG. 7, the method includes:

Step 101: Acquire grayscales of pixels in a frame of input image.

That is, 3800×2160 grayscales corresponding to 3800×2160 pixels are acquired.

Step 102: Determine GAMMA voltages corresponding to pixels in two neighboring frames of the output image according to the grayscales of the pixels in the corresponding frame of input image, where a corresponding GAMMA voltage of any pixel in one frame of output image of the two neighboring frames of the output image is greater than a reference voltage corresponding to the pixel, and a corresponding GAMMA voltage of the pixel in the other frame of the two neighboring frames of the output image is less than the reference voltage corresponding to the pixel.

Specifically, it may be that a source driver determines the GAMMA voltages corresponding to the pixels in the two neighboring frames of the output image according to the grayscales of the pixels in the frame of input image by using a digital-to-analog converter.

For example, suppose that in a frame of image with 3800×2160 pixels, the grayscale of a pixel is 160, and a voltage corresponding to the grayscale 160 is 3V. Taking the 3V as a reference voltage, the corresponding GAMMA voltage of the grayscale 160 of the pixel in the first frame of output image of the two neighboring frames of the output image is 3.5V, that is, greater than the reference voltage, and the corresponding GAMMA voltage of the grayscale 160 of the pixel in the second frame of the two neighboring frames of output image is 2.5V, that is, less than the reference voltage. Moreover, for any frame of input image, the grayscales thereof and the corresponding GAMMA voltages both meet the foregoing relationship, that is, the grayscales of the pixels in the frame of input image are separately displayed by using different GAMMA voltages in the two neighboring frames of the output image.

The GAMMA voltages corresponding to the pixels in the two neighboring frames of output image are determined according to the grayscales of the pixels in the frame of input image. That is, the two neighboring frames of output image are determined according to their corresponding frame of input image. For example, a first two neighboring frames of output image are determined according to the corresponding first frame of input image, and a second two neighboring frames of the output image are determined according to the corresponding second frame of input image. That is, a four-frame output image is determined according to a two-frame input image. The number of frames of an output image is twice of that of its input image.

It should be noted herein that in this embodiment of the present disclosure, transmittance corresponding to different voltages is different. The grayscales of the pixels in the frame of input image are separately displayed by using different GAMMA voltages in the two neighboring frames of output image. The corresponding GAMMA voltage of any pixel in the frame of output image of the two neighboring frames of output image is greater than the reference voltage; the corresponding GAMMA voltage of the pixel in the another frame of output image is less than the reference voltage; and an average value of the GAMMA voltages of any pixel in the two neighboring frames of output image may be greater than, less than, or equal to the reference voltage of the pixel in the input image.

Moreover, for a same display device, a correspondence between a voltage and transmittance does not change, and the greater a GAMMA voltage is, the larger the transmittance is. That is, in a frame of input image, transmittance of a grayscale of any pixel in a frame of output image is greater than transmittance of the pixel under the reference voltage; and transmittance of the pixel in another frame of output image is less than the transmittance of the pixel under the reference voltage. Corresponding transmittance of any pixel in the two neighboring frames of output image may be greater than, less than, or equal to corresponding transmittance of the pixel in the input image under the reference voltage, which is not specifically limited in this embodiment of the present disclosure.

It should be noted that in this embodiment of the present disclosure, a grayscale and the reference voltage may meet a curvilinear relationship of GAMMA 2.0; a GAMMA voltage corresponding to a grayscale being greater than the reference voltage may meet a curvilinear relationship of GAMMA 1.5; and a GAMMA voltage corresponding to a grayscale being less than the reference voltage may meet a curvilinear relationship of GAMMA 2.5. Specifically, a curvilinear relationship between the grayscale and the GAMMA voltage is not specifically limited in this embodiment of the present disclosure, and is described by merely using the foregoing examples.

Step 103: Display the two neighboring frames of output image according to the GAMMA voltages of the pixels in the two neighboring frames of output image.

That is, data voltages corresponding to the pixels are output in a display module of the four-subdomain liquid crystal display television, so as to display the two neighboring frames of output image on the display device.

In the image display method according to this embodiment of the present disclosure, a frame of input image is separately displayed by using different GAMMA voltages in two neighboring frames of the output image; a corresponding GAMMA voltage of any pixel in a frame of output image of the two neighboring frames of output image is greater than a reference voltage corresponding to the pixel, and a corresponding GAMMA voltage of the pixel in another frame of output image is less than the reference voltage corresponding to the pixel. Moreover, for a same display device, a correspondence between a voltage and transmittance does not change, that is, the transmittance of a grayscale of any pixel in a frame of input image under the reference voltage is greater than the transmittance of grayscale of the corresponding pixel in one corresponding frame of the output image but is less than the transmittance of grayscale of the corresponding pixel in the other corresponding frame of the output image. Human eyes see things by integrating images over time, thus a display image received by the human eyes is overlapping of the two-frame output image. For a four-subdomain display device, four different liquid crystal directors can be seen from each frame, and the human eyes can see eight different liquid crystal directors from two neighboring frames, thereby improving a property of a display viewing angle. That is, eight-subdomain viewing angle display effects can be implemented based on a four-subdomain display device, thereby implementing high resolution display and having high transmittance and a large viewing angle when a display panel is not changed.

In an exemplary embodiment, step 101 may further include: acquiring the grayscales of the pixels in the frame of input image at a first frequency; and step 103 may further include: displaying the two neighboring frames of output image at a second frequency, and the second frequency is twice of the first frequency.

A frequency of acquiring an input image and a frequency of displaying an output image of an existing four-subdomain liquid crystal display television are the same, and generally are 60 Hz. In the image display method according to this embodiment of the present disclosure, the four-subdomain liquid crystal display television acquires the grayscales of 3800×2160 pixels in the frame of input image at a frequency of 60 Hz, and displays the two neighboring frames of output image at a frequency of 120 Hz. That is, an image display frequency of the four-subdomain liquid crystal display television in this embodiment of the present disclosure is twice that of the existing four-subdomain liquid crystal display television, that is, a frame of image is changed into two frames of neighboring image to be displayed. Owing to a double speed (that is, to 120 Hz of this embodiment of the present disclosure from existing 60 Hz), time for each picture can be shortened, so that human eyes cannot be aware of the difference between the two frames, which is further beneficial to a viewing angle display effect of high resolution display. Further, as shown in FIG. 8, before step 102, the method further includes:

Step 104: Acquire GAMMA voltages corresponding to two groups of grayscales, where GAMMA voltages corresponding to grayscales in one group are greater than a corresponding reference voltage, and GAMMA voltages corresponding to grayscales in another group are less than the corresponding reference voltage. The GAMMA voltages corresponding to the two groups of grayscales may be GAMMA voltages corresponding to a part of the grayscales, and may also be GAMMA voltages corresponding to all the grayscales.

Specifically, that the source driver may acquire GAMMA voltages corresponding to a part of grayscales that is output by a Gamma voltage processing chip to the source driver is used as an example. For example, by using that display grayscales include 0-255 grayscales as an example, the GAMMA voltages corresponding to a part of the grayscales may be GAMMA voltages corresponding to any 8, 16, or the like of the 0-255 grayscales. Moreover, for GAMMA voltages corresponding to two groups of a part of grayscales, grayscales in one group may be the same as, different from, or partially same as grayscales in another group. For example, the two groups respectively include GAMMA voltages corresponding to 8 grayscales, where 8 grayscales in one group may be 4, 8, 16, 32, 64, 128, 164, and 225, and a GAMMA voltage corresponding to each grayscale of the 8 grayscales is separately greater than a reference voltage corresponding thereto; and 8 grayscales in another group may be 4, 10, 40, 80, 120, 160, 200, and 255, and a GAMMA voltage corresponding to each grayscale of the 8 grayscales is separately less than a reference voltage corresponding thereto. The grayscales of the two groups are partially same and partially different.

Step 102 may include: determining the GAMMA voltages corresponding to the pixels in the two neighboring frames of output image according to the grayscales of the pixels in the frame of input image and the GAMMA voltages corresponding to the two groups of grayscales.

It may be that the source driver determines the GAMMA voltages corresponding to the pixels in the two neighboring frames of output image according to the grayscales of the pixels in the frame of input image and the GAMMA voltages corresponding to the two groups of grayscales by using the digital-to-analog converter.

Step 104 may be specifically: acquiring the GAMMA voltages corresponding to the two groups of grayscales at a first frequency; and step 103 may include: displaying the two neighboring frames of output image at a second frequency, and the second frequency is twice of the first frequency.

It should be noted that step 104 is performed before step 201; step 104 may be before step 101, or after step 101 and before step 102, and may be performed at the same time as step 101. This embodiment of the present disclosure is described in detail by merely using what is shown in FIG. 8 as an example.

In an exemplary embodiment, in grayscale ranges of 0-25 and 230-255, a difference between transmittance of a pixel under a reference voltage corresponding to any grayscale and transmittance of the pixel under a GAMMA voltage corresponding to the grayscale is not greater than 10%; and in a grayscale range of 26-229, a difference between transmittance of a pixel under a reference voltage corresponding to any grayscale and transmittance of the pixel under a GAMMA voltage corresponding to the grayscale is not greater than 40%.

By using that grayscales of any two pixels in the input image are separately 25 and 160 as an example, if a grayscale of any pixel in the input image is 25; a reference voltage corresponding to the grayscale 25 is 0.5V; and corresponding transmittance under the reference voltage is 0.6%, GAMMA voltages of the pixel in the two neighboring frames of output image are respectively 0.4V and 0.6V, where when a GAMMA voltage is 0.4V, transmittance corresponding thereto is 0.3%; and when a GAMMA voltage is 0.6V, transmittance corresponding thereto is 0.9%, between which and transmittance of the pixel under the reference voltage in the input image there are differences both equal to 0.3%. That is, a difference between transmittance of a pixel under a reference voltage corresponding to a grayscale and transmittance of the pixel under a GAMMA voltage corresponding to the grayscale is not greater than 10%; and if a grayscale of any pixel in the input image is 160; a reference voltage corresponding to the grayscale 160 is 3V; and corresponding transmittance under the reference voltage is 36%, GAMMA voltages of the pixel in the two neighboring frames of output image are respectively 2.5V and 3.5V, where when a GAMMA voltage is 2.5V, transmittance corresponding thereto is 20%; and when a GAMMA voltage is 3.5V, transmittance corresponding thereto is 58%, between which and transmittance of the pixel under the reference voltage in the input image there are differences being respectively 16% and 22%. That is, a difference between transmittance of a pixel under a reference voltage corresponding to a grayscale and transmittance of the pixel under a GAMMA voltage corresponding to the grayscale is greater than 10% but less than 40%.

That is because in a white grayscale range, that is, grayscales are between 0-25 and a black grayscale range, that is, grayscales are between of 230-255, and an increase in a GAMMA voltage has little impact on transmittance. However, for a grayscale of a middle part, that is, grayscales are in the grayscale range of 26-229, the increase in the GAMMA voltage has a great impact on the transmittance. In an exemplary embodiment, in order not to affect brightness deviations of a black field and a white field, in white and black situations, a difference between transmittance of a pixel under a reference voltage corresponding to a grayscale in the output image and transmittance of the pixel under a GAMMA voltage corresponding to the grayscale is not greater than 10%; and for the grayscale of a middle part, a difference between transmittance of a pixel under a reference voltage corresponding to any grayscale and transmittance of the pixel under a GAMMA voltage corresponding to the grayscale is not greater than 40%.

It should be noted that because the maximum absolute transmittance of a liquid crystal display panel is about 5%, the transmittance in this embodiment of the present disclosure is relative transmittance, that is, a ratio of transmittance corresponding to each grayscale to the maximum absolute transmittance. Moreover, transmittance of the liquid crystal display panel is different transmittance implemented by controlling, by an electric field formed by a pixel electrode and a common electrode, a liquid crystal deflection angle. This embodiment of the present disclosure is described by using that the common electrode is used as a constant value, and a voltage of the pixel electrode is proportional to a GAMMA voltage, that is, the greater the GAMMA voltage is, the larger the liquid crystal deflection angle is, and the larger the transmittance is as an example. GAMMA voltages corresponding to grayscales in different display apparatuses may be different, which is not described in this embodiment of the present disclosure again.

In order to further improve a display effect of Embodiment 1 of the present disclosure, this embodiment of the present disclosure further provides a space compensation method. That is, in the two neighboring frames of output image, a corresponding GAMMA voltage of a pixel in any two neighboring pixels is greater than a reference voltage corresponding to the pixel, and a corresponding GAMMA voltage of another pixel is less than a reference voltage corresponding to the pixel.

Specifically, as shown in FIG. 9, a, b, c, and d are four neighboring pixels, GAMMA voltages of pixels in two neighboring frames of output image are determined according to grayscales of pixels in a frame of input image. The two neighboring frames of the output image are respectively an ith frame output image and an i+1th frame output image. A GAMMA voltage of the pixel a in the ith frame output image is greater than a reference voltage corresponding to the pixel a, and a GAMMA voltage of the pixel a in the i+1th frame output image is less than the reference voltage corresponding to the pixel a. GAMMA voltages of the pixel b and the pixel c that are next to the pixel a in the ith frame output image is less than reference voltages corresponding to the pixel b and the pixel c, and GAMMA voltages of the pixel b and the pixel c in the i+1th frame output image is greater than the reference voltages corresponding to the pixel b and the pixel c.

As follows, this embodiment of the present disclosure provides an image display apparatus corresponding to the image display method in Embodiment 1 of the present disclosure. It should be noted that functional units included in the following apparatus can execute corresponding steps in the foregoing method. Therefore, the functional units of the apparatus are not described in detail in the following embodiment.

Figure 10:
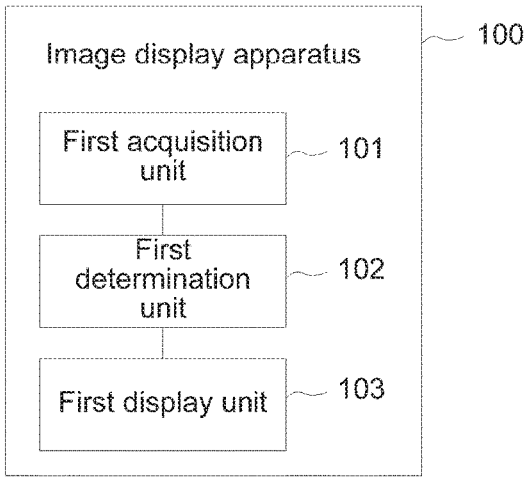
FIG. 10 is a schematic illustration of an image display apparatus according to an embodiment of the present disclosure.

This embodiment of the present disclosure provides an image display apparatus 100 applied to a multi-domain liquid crystal display device. As shown in FIG. 10, the image display apparatus 100 includes:

A first acquisition unit 101 is configured to acquire grayscales of pixels in a frame of input image.

For example, as shown in FIG. 6, the first acquisition unit may be a source driver, or the first acquisition unit may also be another processing chip or the like that has a function of acquiring the grayscales of the pixels in the frame of input image. The first acquisition unit may be configured to acquire the grayscales of the pixels in the frame of input image.

A first determination unit 102 is configured to determine GAMMA voltages corresponding to pixels in two neighboring frames of output image according to the grayscales of the pixels in the frame of input image, where a corresponding GAMMA voltage of any pixel in a frame of output image of the two neighboring frames of output image is greater than a reference voltage corresponding to the pixel, and a corresponding GAMMA voltage of the pixel in another frame of output image is less than the reference voltage corresponding to the pixel.

For example, as shown in FIG. 6, the first determination unit may be a source driver or the like.

A first display unit 103 is configured to display the two neighboring frames of output image according to the GAMMA voltages of the pixels in the two neighboring frames of output image.

For example, the first display unit may be a display module shown in FIG. 6. For example, the source driver in the display module determines GAMMA voltages corresponding to the pixels by using a digital-to-analog converter according to the GAMMA voltages corresponding to a part of the grayscales output by the Gamma voltage processing chip, obtains data voltages through calculation, and outputs the data voltages to the pixels by using data lines. By using a liquid crystal display device as an example, different data voltages control liquid crystals of different pixels to deflect for different angles, so that transmittance of the pixels is different. The first display unit may be configured to display the two neighboring frames of output image at a second frequency.

In the image display apparatus according to this embodiment of the present disclosure, a frame of input image is separately displayed by using different GAMMA voltages in two neighboring frames of an output image; a corresponding GAMMA voltage of any pixel in the first frame of the output image is greater than a reference voltage, and a corresponding GAMMA voltage of the pixel in the second frame of the output image is less than the reference voltage. Moreover, for the same display device, a correspondence between a voltage and transmittance does not change, that is, transmittance of a grayscale of any pixel in the first frame of output image is greater than transmittance of the pixel under the reference voltage, and transmittance of the grayscale under the second frame of the output image is less than the transmittance of the pixel under the reference voltage. Relying on integration effects of human eyes over time, a display image received by the human eyes is overlapping of the two frames of the output image. For a four-subdomain display device, four different liquid crystal directors can be seen from each frame, and the human eyes can see eight different liquid crystal directors from two neighboring frames, thereby improving a property of a display viewing angle. That is, eight-subdomain viewing angle display effects can be implemented based on a four-subdomain display device, thereby implementing high resolution display and having high transmittance and a large viewing angle when a display panel is not changed.

Further, the first acquisition unit is further configured to acquire GAMMA voltages corresponding to two groups of grayscales, where GAMMA voltages corresponding to grayscales in one group are greater than a corresponding reference voltage, and GAMMA voltages corresponding to grayscales in another group are less than the corresponding reference voltage. The first determination unit may be configured to determine the GAMMA voltages corresponding to the pixels in the two neighboring frames of output image according to the grayscales of the pixels in the frame of input image and the GAMMA voltages corresponding to the two groups of grayscales. The GAMMA voltages corresponding to the two groups of grayscales may be GAMMA voltages corresponding to a part of the grayscales, and may also be GAMMA voltages corresponding to all the grayscales.

For example, the source driver may determine the GAMMA voltages corresponding to the pixels in the two neighboring frames of output image according to the grayscales of the pixels in the frame of input image and the GAMMA voltages corresponding to the two groups of grayscales by using the digital-to-analog converter.

In an exemplary embodiment, the first acquisition unit may acquire the GAMMA voltages corresponding to the two groups of grayscales at a first frequency; and the first display unit may display the two neighboring frames of output image at the second frequency, and the second frequency is twice of the first frequency.

In an exemplary embodiment, in grayscale ranges of 0-25 and 230-255, a difference between transmittance of a pixel under a reference voltage corresponding to any grayscale and transmittance of the pixel under a GAMMA voltage corresponding to the grayscale is not greater than 10%; and in a grayscale range of 26-229, a difference between transmittance of a pixel under a reference voltage corresponding to any grayscale and transmittance of the pixel under a GAMMA voltage corresponding to the grayscale is not greater than 40%.

For example, by using that grayscales of any two pixels in the input image are separately 25 and 160 as an example, if a grayscale of any pixel in the input image is 25; a reference voltage corresponding to the grayscale 25 is 0.5V; and corresponding transmittance under the reference voltage is 0.6%, GAMMA voltages of the pixel in the two neighboring frames of output image are respectively 0.4V and 0.6V, where when a GAMMA voltage is 0.4V, transmittance corresponding thereto is 0.3%; and when a GAMMA voltage is 0.6V, transmittance corresponding thereto is 0.9%, between which and transmittance of the pixel under the reference voltage in the input image there are differences both equal to 0.3%. That is, a difference between transmittance of a pixel under a reference voltage corresponding to a grayscale and transmittance of the pixel under a GAMMA voltage corresponding to the grayscale is not greater than 10%; and if a grayscale of any pixel in the input image is 160; a reference voltage corresponding to the grayscale 160 is 3V; and corresponding transmittance under the reference voltage is 36%, GAMMA voltages of the pixel in the two neighboring frames of output image are respectively 2.5V and 3.5V, where when a GAMMA voltage is 2.5V, transmittance corresponding thereto is 20%; and when a GAMMA voltage is 3.5V, transmittance corresponding thereto is 58%, between which and transmittance of the pixel under the reference voltage in the input image there are differences being respectively 16% and 22%. That is, a difference between transmittance of a pixel under a reference voltage corresponding to a grayscale and transmittance of the pixel under a GAMMA voltage corresponding to the grayscale is greater than 10% but less than 40%.

That is because in a white grayscale range, that is, grayscales are between 0-25 and a black grayscale range, that is, grayscales are between of 230-255, an increase in a GAMMA voltage has little impact on transmittance. However, for a grayscale of a middle part, that is, grayscales are in the grayscale range of 26-229, the increase in the GAMMA voltage has a great impact on the transmittance. In an exemplary embodiment, in order not to affect brightness deviations of a black field and a white field, in white and black situations, a difference between transmittance of a pixel under a reference voltage corresponding to a grayscale in the output image and transmittance of the pixel under a GAMMA voltage corresponding to the grayscale is not greater than 10%; and for the grayscale of a middle part, a difference between transmittance of a pixel under a reference voltage corresponding to any grayscale and transmittance of the pixel under a GAMMA voltage corresponding to the grayscale is not greater than 40%.

In order to further improve a display effect of Embodiment 1 of the present disclosure, this embodiment of the present disclosure further provides a space compensation method. That is, in the two neighboring frames of output image, a corresponding GAMMA voltage of a pixel in any two neighboring pixels is greater than a reference voltage corresponding to the pixel, and a corresponding GAMMA voltage of another pixel is less than a reference voltage corresponding to the pixel.

For example, as shown in FIG. 9, a, b, c, and d are four neighboring pixels, GAMMA voltages of pixels in two neighboring frames of output image are determined according to grayscales of pixels in a frame of input image. The two neighboring frames of the output image are respectively an ith frame output image and an i+1th frame output image. A GAMMA voltage of the pixel a in the ith frame output image is greater than a reference voltage corresponding to the pixel a, and a GAMMA voltage of the pixel a in the i+1th frame output image is less than the reference voltage corresponding to the pixel a. GAMMA voltages of the pixel b and the pixel c that are next to the pixel a in the ith frame output image is less than reference voltages corresponding to the pixel b and the pixel c, and GAMMA voltages of the pixel b and the pixel c in the i+1th frame output image is greater than the reference voltages corresponding to the pixel b and the pixel c.

This embodiment of the present disclosure provides a multi-domain liquid crystal display device, including the image display apparatus in embodiment 1 of the present disclosure.

Embodiment 2

This embodiment of the present disclosure provides another image display method and apparatus applied to a multi-domain liquid crystal display device. In reality, the multi-domain liquid crystal display device may be a television, an online video playback device, or the like. This embodiment of the present disclosure is described in detail by using that the multi-domain liquid crystal display device is a four-subdomain liquid crystal display television whose resolution is 3800×2160 as an example.

Figure 11:
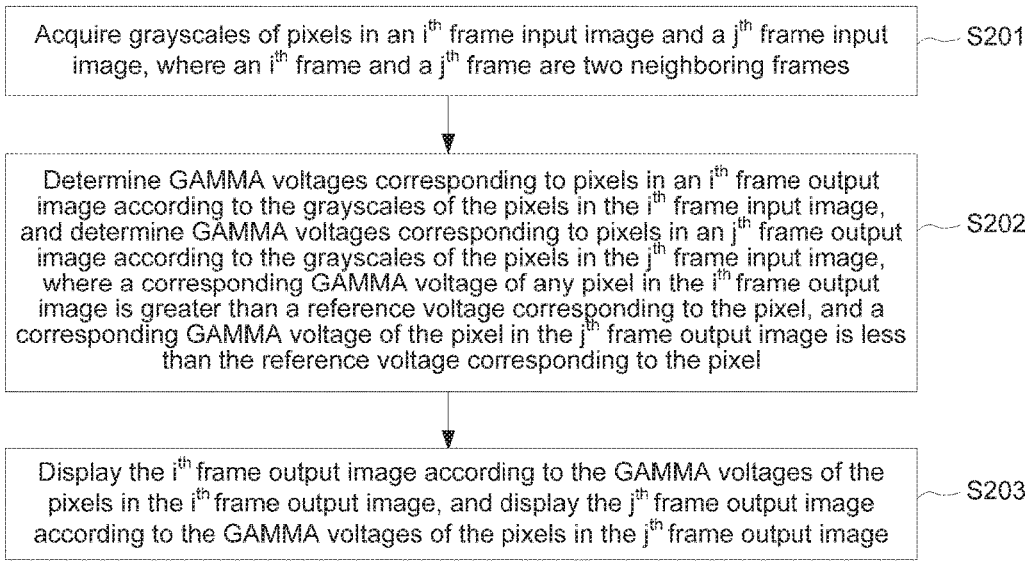
FIG. 11 is a flowchart of an image display method according to an embodiment of the present disclosure.

As shown in FIG. 11, the image display method includes:

Step 201: Acquire grayscales of pixels in an ith frame input image and a jth frame input image, where an ith frame and a jth frame are two neighboring frames.

For example, the ith frame and the jth frame are two neighboring frames, and the jth frame may be an i−1th frame, or may be an i+1th frame. This embodiment of the present disclosure does not specifically limit a sequential order of the ith frame and the jth frame.

Step 202: Determine GAMMA voltages corresponding to pixels in an ith frame output image according to the grayscales of the pixels in the ith frame input image, and determine GAMMA voltages corresponding to pixels in an jth frame output image according to the grayscales of the pixels in the jth frame input image, where a corresponding GAMMA voltage of any pixel in the ith frame output image is greater than a reference voltage corresponding to the pixel, and a corresponding GAMMA voltage of the pixel in the jth frame output image is less than the reference voltage corresponding to the pixel.

Exemplarily, a grayscale of a pixel in acquired 3800×2160 pixels in the ith frame input image is 160; a reference voltage corresponding to the grayscale 160 is 3V; and corresponding transmittance under the reference voltage thereof is 36%. A GAMMA voltages corresponding to the pixel in the ith frame output image is determined to be 3.5V, and when the GAMMA voltage is 3.5V, transmittance corresponding thereto is 58%. That is, corresponding GAMMA voltage of the pixel in the jth frame output image is greater than the reference voltage.

A grayscale of any pixel in the jth frame input image is 25; a reference voltage corresponding to the grayscale 25 is 0.5V; and corresponding transmittance under the reference voltage is 0.6%. A GAMMA voltages corresponding to the pixel is determined to be 0.4V, and when the GAMMA voltage is 0.4V, transmittance corresponding thereto is 0.3%. That is, corresponding GAMMA voltage of any pixel in the jth frame output image is less than the reference voltage.

That is, a corresponding GAMMA voltage of any pixel in the ith frame output image is greater than the reference voltage corresponding to the pixel, and a corresponding GAMMA voltage of the pixel in the jth frame output image is less than the reference voltage corresponding to the pixel.

It should be noted that in this embodiment of the present disclosure, a grayscale and the reference voltage may meet a curvilinear relationship of GAMMA 2.0; a GAMMA voltage corresponding to a grayscale being greater than the reference voltage may meet a curvilinear relationship of GAMMA 1.5; and a GAMMA voltage corresponding to a grayscale being less than the reference voltage may meet a curvilinear relationship of GAMMA 2.5. For example, a curvilinear relationship between the grayscale and the GAMMA voltage is not specifically limited in this embodiment of the present disclosure.

Step 203: Display the ith frame output image according to the GAMMA voltages of the pixels in the ith frame output image, and display the jth frame output image according to the GAMMA voltages of the pixels in the jth frame output image.

That is, data voltages corresponding to the pixels are output in a display module of the four-subdomain liquid crystal display television, so as to display the ith frame output image and the jth frame output image on the display device.

It should be noted that in step 201 and step 202, the grayscales of the pixels in the ith frame input image are acquired; the grayscales of the pixels in the jth frame input image are acquired; the GAMMA voltages corresponding to the pixels in the ith frame output image are determined according to the grayscales of the pixels in the ith frame input image; and the GAMMA voltages corresponding to the pixels in the jth frame output image are determined according to the grayscales of the pixels in the jth frame input image. A sequential order of the specific processing steps is not specifically limited in this embodiment of the present disclosure. For example, the sequential order may be that: the grayscales of the pixels in the ith frame input image are acquired; the GAMMA voltages corresponding to the pixels in the ith frame output image are determined according to the grayscales of the pixels in the ith frame input image; and the ith frame output image is displayed according to the GAMMA voltages of the pixels in the ith frame output image; and afterwards, the grayscales of the pixels in the jth frame input image are acquired; the GAMMA voltages corresponding to the pixels in the jth frame output image are determined according to the grayscales of the pixels in the jth frame input image; and the jth frame output image is displayed according to the GAMMA voltages of the pixels in the jth frame output image, as long as a corresponding GAMMA voltage of any pixel in the ith frame output image is greater than the reference voltage corresponding to the pixel, and a corresponding GAMMA voltage of the pixel in the jth frame output image is less than the reference voltage corresponding to the pixel.

In the image display method according to this embodiment of the present disclosure, grayscales of pixels in an ith frame input image and a jth frame input image are acquired; GAMMA voltages corresponding to pixels in an ith frame output image are determined according to the grayscales of the pixels in the ith frame input image; and GAMMA voltages corresponding to pixels in an jth frame output image are determined according to the grayscales of the pixels in the jth frame input image, where a corresponding GAMMA voltage of any pixel in the ith frame output image is greater than a reference voltage corresponding to the pixel, and a corresponding GAMMA voltage of the pixel in the jth frame output image is less than the reference voltage corresponding to the pixel. Moreover, for a same display device, a correspondence between a voltage and transmittance does not change, that is, transmittance of a grayscale of any pixel in the first frame of output image is greater than transmittance of the pixel under the reference voltage, and transmittance of the grayscale under the second frame of the output image is less than the transmittance of the pixel under the reference voltage. Relying on integration effects of human eyes over time, a display image received by the human eyes is overlapping of the two-frame output image. For a four-subdomain display device, four different liquid crystal directors can be seen from each frame, and the human eyes can see eight different liquid crystal directors from two neighboring frames, thereby improving a property of a display viewing angle. That is, eight-subdomain viewing angle display effects can be implemented based on a four-subdomain display device, thereby implementing high resolution display and having high transmittance and a large viewing angle when a display panel is not changed.

In an exemplary embodiment, step 201 may include: acquiring the grayscales of the pixels in the ith frame input image and the jth frame input image at a third frequency; and step 203 may include: displaying the ith frame output image at the third frequency, and displaying the jth frame output image at the third frequency.

Embodiment 2 is different from Embodiment 1 in that: the frequency of acquiring the ith frame input image and the jth frame input image is equal to the frequency of displaying the ith frame output image and the jth frame output image. In Embodiment 2, integration effects of human eyes are mainly used, and a display image received by the human eyes is overlapping of the two-frame output image, which further improves display resolution.

Figure 12:
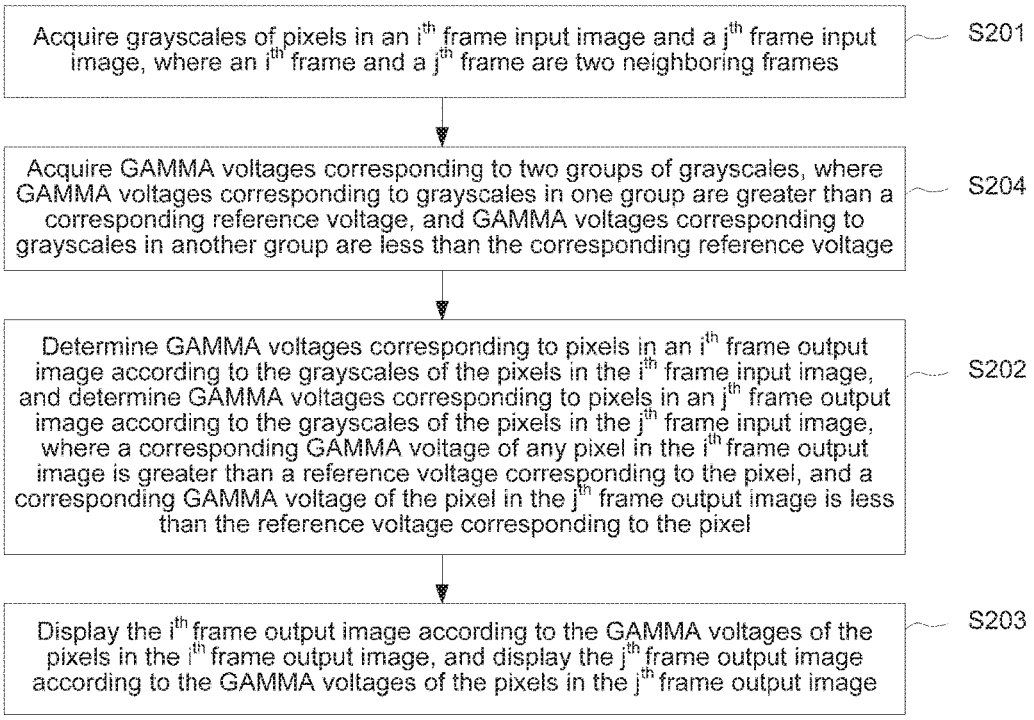
FIG. 12 is a flowchart of an image display method according to an embodiment of the present disclosure.

Further, as shown in FIG. 12, before step 202, the method further includes:

Step 204: Acquire GAMMA voltages corresponding to two groups of grayscales, where GAMMA voltages corresponding to grayscales in one group are greater than a corresponding reference voltage, and GAMMA voltages corresponding to grayscales in another group are less than the corresponding reference voltage. The GAMMA voltages corresponding to the two groups of grayscales may be GAMMA voltages corresponding to a part of the grayscales, and may also be GAMMA voltages corresponding to all the grayscales.

For example, that the source driver may acquire GAMMA voltages corresponding to a part of grayscales that is output by a Gamma voltage processing chip to the source driver is used as an example. For example, by using that display grayscales include 0-255 grayscales as an example, the GAMMA voltages corresponding to a part of the grayscales may be GAMMA voltages corresponding to any 8, 16, or the like of the 0-255 grayscales. Moreover, for GAMMA voltages corresponding to two groups of a part of grayscales, grayscales in one group may be the same as, different from, or partially same as grayscales in another group. For details, reference may be made to the description in step 104, which is not described herein again.

Step 202 may include: determining the GAMMA voltages corresponding to the pixels in the ith frame output image according to the grayscales of the pixels in the ith frame input image and the GAMMA voltages corresponding to the two groups of grayscales; and determining the GAMMA voltages corresponding to the pixels in the jth frame output image according to the grayscales of the pixels in the jth frame input image and the GAMMA voltages corresponding to the two groups of grayscales.

It may be that the source driver determines the GAMMA voltages corresponding to the pixels in the two neighboring frames of output image according to the grayscales of the pixels in the frame of input image and the GAMMA voltages corresponding to the two groups of grayscales by using the digital-to-analog converter.

Step 204 may include: acquiring the GAMMA voltages corresponding to the two groups of grayscales at a third frequency; and step 103 may include: displaying the two neighboring frames of output image at the third frequency.

It should be noted that step 204 is performed before step 201; step 204 may be before step 201, or after step 201 and before step 202, and may be performed at the same time as step 201. This embodiment of the present disclosure is described in detail by merely using what is shown in FIG. 12 as an example.

In an exemplary embodiment, in grayscale ranges of 0-25 and 230-255, a difference between transmittance of a pixel under a reference voltage corresponding to any grayscale and transmittance of the pixel under a GAMMA voltage corresponding to the grayscale is not greater than 10%; and in a grayscale range of 26-229, a difference between transmittance of a pixel under a reference voltage corresponding to any grayscale and transmittance of the pixel under a GAMMA voltage corresponding to the grayscale is not greater than 40%.

That is because in a white grayscale range, that is, grayscales are between 0-25 and a black grayscale range, that is, grayscales are between of 230-255, an increase in a GAMMA voltage has little impact on transmittance. However, for a grayscale of a middle part, that is, grayscales are in the grayscale range of 26-229, the increase in the GAMMA voltage has a great impact on the transmittance. In an exemplary embodiment, in order not to affect brightness deviations of a black field and a white field, in white and black situations, a difference between transmittance of a pixel under a reference voltage corresponding to a grayscale in the output image and transmittance of the pixel under a GAMMA voltage corresponding to the grayscale is not greater than 10%; and for the grayscale of a middle part, a difference between transmittance of a pixel under a reference voltage corresponding to any grayscale and transmittance of the pixel under a GAMMA voltage corresponding to the grayscale is not greater than 40%.

In order to further improve a display effect of Embodiment 1 of the present disclosure, this embodiment of the present disclosure further provides a space compensation method. That is, in the ith frame image or the jth frame image, a corresponding GAMMA voltage of a pixel in any two neighboring pixels is greater than a reference voltage corresponding to the pixel, and a corresponding GAMMA voltage of another pixel is less than a reference voltage corresponding to the pixel.

By using that the jth frame output image is the i+1th frame output image as an example, reference can be made to four pixels shown in FIG. 9, a GAMMA voltage of the pixel a in the ith frame output image is greater than a reference voltage corresponding to the pixel a, and a GAMMA voltage of the pixel a in the i+1th frame output image is less than the reference voltage corresponding to the pixel a. GAMMA voltages of the pixel b and the pixel c that are next to the pixel a in the ith frame output image is less than reference voltages corresponding to the pixel b and the pixel c, and GAMMA voltages of the pixel b and the pixel c in the i+1th frame output image is greater than the reference voltages corresponding to the pixel b and the pixel c.

As follows, this embodiment of the present disclosure provides an image display apparatus corresponding to the image display method in Embodiment 2 of the present disclosure. It should be noted that functional units included in the following apparatus can execute corresponding steps in the foregoing method. Therefore, the functional units of the apparatus are not described in detail in the following embodiment.

Figure 13:
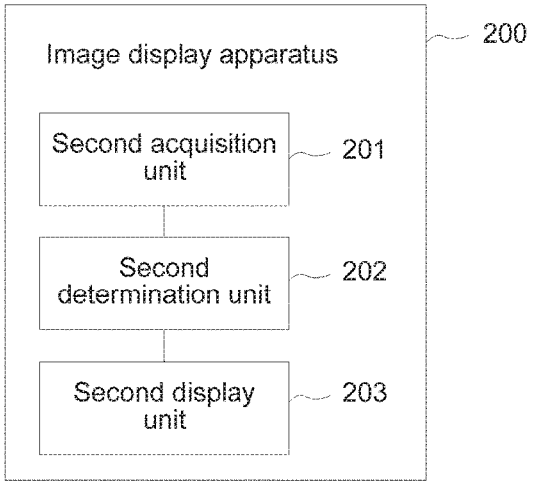
FIG. 13 is a schematic illustration of another image display apparatus according to an embodiment of the present disclosure.

This embodiment of the present disclosure provides an image display apparatus 200 applied to a multi-domain liquid crystal display device. As shown in FIG. 13, the image display apparatus 200 includes:

A second acquisition unit 201 is configured to acquire grayscales of pixels in an ith frame input image and a jth frame input image, where an ith frame and a jth frame are two neighboring frames.

For example, as shown in FIG. 6, the first acquisition unit may be a source driver, or the first acquisition unit may also be another processing chip or the like that has a function of acquiring the grayscales of the pixels in the frame of input image. The second acquisition unit may be configured to acquire the grayscales of the pixels in the ith frame input image and the jth frame input image at a third frequency. For example, the third frequency may be 60 Hz, and may also be 120 Hz.

A second determination unit 202 is configured to determine GAMMA voltages corresponding to pixels in an ith frame output image according to the grayscales of the pixels in the ith frame input image, and determining GAMMA voltages corresponding to pixels in an jth frame output image according to the grayscales of the pixels in the jth frame input image, where a corresponding GAMMA voltage of any pixel in the ith frame output image is greater than a reference voltage corresponding to the pixel, and a corresponding GAMMA voltage of the pixel in the jth frame output image is less than the reference voltage corresponding to the pixel.

For example, as shown in FIG. 6, the first determination unit may be a source driver or the like.

A second display unit 203 is configured to display the ith frame output image according to the GAMMA voltages of the pixels in the ith frame output image, and display the jth frame output image according to the GAMMA voltages of the pixels in the jth frame output image.

For example, the first display unit may be a display module shown in FIG. 6. For example, the source driver in the display module determines GAMMA voltages corresponding to the pixels by using a digital-to-analog converter according to the GAMMA voltages corresponding to a part of the grayscales output by the Gamma voltage processing chip, obtains data voltages through calculation, and outputs the data voltages to the pixels by using data lines. By using a liquid crystal display device as an example, different data voltages control liquid crystals of different pixels to deflect for different angles, so that transmittance of the pixels is different. The second display unit may be configured to display the ith frame output image at the third frequency, and display the jth frame output image at the third frequency.

In the image display apparatus according to this embodiment of the present disclosure, grayscales of pixels in an ith frame input image and a jth frame input image are acquired; GAMMA voltages corresponding to pixels in an ith frame output image are determined according to the grayscales of the pixels in the ith frame input image; and GAMMA voltages corresponding to pixels in an jth frame output image are determined according to the grayscales of the pixels in the jth frame input image, where a corresponding GAMMA voltage of any pixel in the ith frame output image is greater than a reference voltage corresponding to the pixel, and a corresponding GAMMA voltage of the pixel in the jth frame output image is less than the reference voltage corresponding to the pixel. Moreover, for a same display device, a correspondence between a voltage and transmittance does not change, that is, transmittance of a grayscale of any pixel in the first frame of the output image is greater than transmittance of the pixel under the reference voltage, and transmittance of the grayscale of the pixel in the second frame of the output image is less than the transmittance of the pixel under the reference voltage. Relying on integration effects of human eyes over time, a display image received by the human eyes is overlapping of the two-frame output image. For a four-subdomain display device, four different liquid crystal directors can be seen from each frame, and the human eyes can see eight different liquid crystal directors from two neighboring frames, thereby improving a property of a display viewing angle. That is, eight-subdomain viewing angle display effects can be implemented based on a four-subdomain display device, thereby implementing high resolution display and having high transmittance and a large viewing angle when a display panel is not changed.

Further, the second acquisition unit is further configured to acquire GAMMA voltages corresponding to two groups of grayscales, where GAMMA voltages corresponding to grayscales in one group are greater than a corresponding reference voltage, and GAMMA voltages corresponding to grayscales in another group are less than the corresponding reference voltage. The second determination unit may be configured to determine the GAMMA voltages corresponding to the pixels in the two neighboring frames of output image according to the grayscales of the pixels in the frame of input image and the GAMMA voltages corresponding to the two groups of grayscales. The GAMMA voltages corresponding to the two groups of grayscales may be GAMMA voltages corresponding to a part of the grayscales, and may also be GAMMA voltages corresponding to all the grayscales.

For example, the source driver may determine the GAMMA voltages corresponding to the pixels in the two neighboring frames of output image according to the grayscales of the pixels in the frame of input image and the GAMMA voltages corresponding to the two groups of grayscales by using the digital-to-analog converter.

In an exemplary embodiment, the second acquisition unit may acquire the GAMMA voltages corresponding to the two groups of grayscales at a third frequency; and the second display unit may display the two neighboring frames of output image at the third frequency.

In an exemplary embodiment, in grayscale ranges of 0-25 and 230-255, a difference between transmittance of a pixel under a reference voltage corresponding to any grayscale and transmittance of the pixel under a GAMMA voltage corresponding to the grayscale is not greater than 10%; and in a grayscale range of 26-229, a difference between transmittance of a pixel under a reference voltage corresponding to any grayscale and transmittance of the pixel under a GAMMA voltage corresponding to the grayscale is not greater than 40%.

That is because in a white grayscale range, that is, grayscales are between 0-25 and a black grayscale range, that is, grayscales are between of 230-255, an increase in a GAMMA voltage has little impact on transmittance. However, for a grayscale of a middle part, that is, grayscales are in the grayscale range of 26-229, the increase in the GAMMA voltage has a great impact on the transmittance. In an exemplary embodiment, in order not to affect brightness deviations of a black field and a white field, in white and black situations, a difference between transmittance of a pixel under a reference voltage corresponding to a grayscale in the output image and transmittance of the pixel under a GAMMA voltage corresponding to the grayscale is not greater than 10%; and for the grayscale of a middle part, a difference between transmittance of a pixel under a reference voltage corresponding to any grayscale and transmittance of the pixel under a GAMMA voltage corresponding to the grayscale is not greater than 40%.

In order to further improve a display effect of Embodiment 1 of the present disclosure, this embodiment of the present disclosure further provides a space compensation method. That is, in the ith frame image or the jth frame image, a corresponding GAMMA voltage of a pixel in any two neighboring pixels is greater than a reference voltage corresponding to the pixel, and a corresponding GAMMA voltage of another pixel is less than a reference voltage corresponding to the pixel.

By using that the jth frame output image is the i+1th frame output image as an example, reference can be made to four pixels shown in FIG. 9, a GAMMA voltage of the pixel a in the ith frame output image is greater than a reference voltage corresponding to the pixel a, and a GAMMA voltage of the pixel a in the i+1th frame output image is less than the reference voltage corresponding to the pixel a. GAMMA voltages of the pixel b and the pixel c that are next to the pixel a in the ith frame output image is less than reference voltages corresponding to the pixel b and the pixel c, and GAMMA voltages of the pixel b and the pixel c in the i+1th frame output image is greater than the reference voltages corresponding to the pixel b and the pixel c.

This embodiment of the present disclosure provides a multi-domain liquid crystal display device, including the image display apparatus in Embodiment 2 of the present disclosure.

The foregoing descriptions are merely specific embodiments of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the appended claims.

The invention claimed is:

1. A multi-domain liquid crystal display device, comprising:

a multi-domain liquid crystal image display apparatus including multiple liquid crystal domains;

a storage medium including a set of instructions for displaying images by the multi-domain liquid crystal image display apparatus; and a processor in communication with the storage medium and the multi-domain liquid crystal image display apparatus, wherein when executing the set of instructions, the processor is directed to:

obtain a first output frame associated with a first image, wherein the first output frame corresponds to a first GAMMA curve having a GAMMA voltage lower than a reference GAMMA curve at each gray level among a set of predetermined gray levels other than at least one lowest gray level and at least one highest gray level of the set of predetermined gray levels;

obtain a second output frame associated with a second image, wherein the second output frame corresponds to a second GAMMA curve having a GAMMA voltage higher than the reference GAMMA curve at each gray level among the set of predetermined gray levels other than the at least one lowest gray level and the at least one highest gray level of the set of predetermined gray levels; and display, on the multi-domain liquid crystal image display apparatus, the first output frame and the second output frame as two neighboring output frames in time with different respective angular viewing-profiles, wherein a single domain of the multiple liquid crystal domains within each controllable pixel of the multi-domain liquid crystal image display apparatus uses the first GAMMA curve when the first output frame is displayed to produce a first respective angular viewing-profile and uses the second GAMMA curve when the second output frame is displayed to produce a second respective angular viewing-profile.

2. The display device according to claim 1, wherein the set of predetermined gray levels includes 256 gray levels represented by integers 0-255 and wherein the at least one lowest gray level comprises gray level 0 and the at least one highest gray level comprises gray level 255.

3. The display device according to claim 1, wherein the set of predetermined gray levels includes 256 gray levels represented by integers 0-255 and wherein the at least one lowest gray level comprises gray levels 0-25 and the at least one highest gray level comprises gray levels 230-255.

4. The display device according to claim 1, wherein the multiple liquid crystal domains comprise four or less liquid crystal domains.

5. The display device according to claim 1, wherein the first image and the second image are a same input image.

6. The display device according to claim 5, wherein the input image is associated with a first frequency and the processor is further directed to:

display, on the multi-domain liquid crystal image display apparatus, the two neighboring output frames at a second frequency different from the first frequency.

7. The display device according to claim 6, wherein the second frequency is twice as much as the first frequency.

8. The display device according to claim 1, wherein the first image and second image are two neighboring input images into the multi-domain liquid crystal display device.

9. The display device according to claim 8, wherein the input images are associated with a third frequency and the processor is further directed to:

display, on the multi-domain liquid crystal image display apparatus, the first output frame and the second output frame at the third frequency.

10. A multi-domain liquid crystal display device, comprising:

a multi-domain liquid crystal image display apparatus including multiple liquid crystal domains;

a storage medium including a set of instructions for displaying images by the multi-domain liquid crystal image display apparatus; and a processor in communication with the storage medium and the multi-domain liquid crystal image display apparatus, wherein when executing the set of instructions, the processor is directed to:

obtain a first output frame associated with a first image, wherein the first output frame corresponds to a first GAMMA curve having a GAMMA voltage lower than a reference GAMMA curve at each gray level among a set of predetermined gray levels other than at least one lowest gray level and at least one highest gray level of the set of predetermined gray levels;

obtain a second output frame associated with a second image, wherein the second output frame corresponds to a second GAMMA curve having a GAMMA voltage higher than the reference GAMMA curve at each gray level among the set of predetermined gray levels other than the at least one lowest gray level and the at least one highest gray level of the set of predetermined gray levels, and;

display, on the multi-domain liquid crystal image display apparatus, the first output frame and the second output frame as two neighboring output frames in time, wherein a single domain of the multiple liquid crystal domains uses the first GAMMA curve when the first output frame is displayed and uses the second GAMMA curve when the second output frame is displayed;

wherein in grayscale ranges of 0-25 and 230-255, a difference between transmittance of a pixel under the reference GAMMA curve and the first GAMMA curve corresponding to any grayscale or a difference between transmittance of the pixel under the reference GAMMA curve and the second GAMMA curve corresponding to the grayscale is not greater than 10%; and wherein in a grayscale range of 26-229, a difference between transmittance of a pixel under the reference GAMMA curve and the first GAMMA curve corresponding to any grayscale or a difference between transmittance of the pixel under the reference GAMMA curve and the second GAMMA curve corresponding to the grayscale is not greater than 40%.

11. The display device according to claim 1, wherein the set of predetermined gray levels includes 256 gray levels represented by integers 0-255 and wherein the at least one lowest gray level comprises gray level 0 and the at least one highest gray level comprises gray level 255.

12. The display device according to claim 10, wherein the first image and second image are two neighboring input images into the multi-domain liquid crystal display device.

13. The display device according to claim 12, wherein the input images are associated with a third frequency and the processor is further directed to:

display, on the multi-domain liquid crystal image display apparatus, the first output frame and the second output frame at the third frequency.

14. A method for displaying images by a multi-domain liquid crystal display device including multiple liquid crystal domains, comprising:

obtaining, by a multi-domain liquid crystal display device, a first output frame associated with a first image, wherein the first output frame corresponds to a first GAMMA curve having a GAMMA voltage lower than a reference GAMMA curve at each gray level among a set of predetermined gray levels other than at least one lowest gray level and at least one highest gray level of the set of predetermined gray levels;

obtaining, by the multi-domain liquid crystal display device, a second output frame associated with a second image, wherein the second output frame corresponds to a second GAMMA curve having a GAMMA voltage higher than the reference GAMMA curve at each gray level among the set of predetermined gray levels other than the at least one lowest gray level and the at least one highest gray level of the set of predetermined gray levels; and displaying, by the multi-domain liquid crystal display device, the first output frame and the second output frame as two neighboring output frames in time with different respective angular viewing-profiles, wherein a single domain of the multiple liquid crystal domains within each controllable pixel of the multi-domain liquid crystal display device uses the first GAMMA curve when the first output frame is displayed to produce a first respective angular viewing-profile and uses the second GAMMA curve when the second output frame is displayed to produce a second respective angular viewing-profile.

15. The method according to claim 14, wherein the set of predetermined gray levels includes 256 gray levels represented by integers 0-255 and wherein the at least one lowest gray level comprises gray level 0 and the at least one highest gray level comprises gray level 255.

16. The method according to claim 14, wherein the first image and the second image are a same input image.

17. The method according to claim 16, wherein the input image is associated with a first frequency, the method further comprising:

displaying, on the multi-domain liquid crystal display device, the two neighboring output frames at a second frequency different from the first frequency.

18. The method according to claim 17, wherein the second frequency is twice as much as the first frequency.

19. The method according to claim 14, wherein the first image and second image are two neighboring input images into the multi-domain liquid crystal display device.

20. The method according to claim 19, wherein the input images are associated with a third frequency and the method further comprises:

displaying, on the multi-domain liquid crystal display device, the first output frame and the second output frame at the third frequency.

* * * * *